US009833074B2

(12) United States Patent
Bohmann et al.

(10) Patent No.: US 9,833,074 B2
(45) Date of Patent: Dec. 5, 2017

(54) FUNCTIONAL CHAIR

(71) Applicant: WALTER KNOLL AG & CO. KG, Herrenberg (DE)

(72) Inventors: Gernot Bohmann, Vienna (AT); Martin Bergmann, Vienna (AT); Harald Gründl, Vienna (AT)

(73) Assignee: WALTER KNOLL AG & CO. KG, Herrenberg (DE)

( * ) Notice: Subject to any disclaimer, the term of this patent is extended or adjusted under 35 U.S.C. 154(b) by 114 days.

(21) Appl. No.: 14/383,215

(22) PCT Filed: Mar. 8, 2013

(86) PCT No.: PCT/EP2013/000702
§ 371 (c)(1),
(2) Date: Feb. 12, 2015

(87) PCT Pub. No.: WO2013/131658
PCT Pub. Date: Sep. 12, 2013

(65) Prior Publication Data

US 2015/0164225 A1 Jun. 18, 2015

(30) Foreign Application Priority Data

Mar. 8, 2012 (DE) ..... 20 2012 002 288 U

(51) Int. Cl.

| | |
|---|---|
| ***A47C 1/00*** | (2006.01) |
| ***A47C 1/032*** | (2006.01) |
| ***A47C 7/44*** | (2006.01) |
| ***A47C 7/42*** | (2006.01) |
| ***A47C 7/54*** | (2006.01) |

(52) U.S. Cl.
CPC ..... *A47C 1/032* (2013.01); *A47C 1/03255* (2013.01); *A47C 1/03266* (2013.01); *A47C 1/03272* (2013.01); *A47C 1/03294* (2013.01); *A47C 7/42* (2013.01); *A47C 7/443* (2013.01); *A47C 7/445* (2013.01); *A47C 7/54* (2013.01)

(58) Field of Classification Search
CPC . A47C 1/032; A47C 1/03255; A47C 1/03266; A47C 1/03272
USPC ..... 297/313, 286, 289, 300.5, 300.8, 303.5, 297/452.21, 452.23, 452.24
See application file for complete search history.

(56) References Cited

U.S. PATENT DOCUMENTS 4,709,963 A * 12/1987 Uecker ..... A47C 1/03255 297/300.5
4,790,598 A 12/1988 Locher
4,848,837 A * 7/1989 Volkle ..... A47C 1/031 297/300.1
5,538,326 A * 7/1996 Lorbiecki ..... A47C 5/12 297/452.15

(Continued)

FOREIGN PATENT DOCUMENTS

CA WO 2014036633 A1 * 3/2014 ..... A47C 1/03255
DE 29615997 U1 * 10/1996 ..... A47C 1/03255

(Continued)

*Primary Examiner* — Jose V Chen

(57) ABSTRACT

A support mechanism for mounting a seat part to a foot part of a functional chair having a slide bearing which cooperates with a front section of the seat part, and a pivotable support part which is supported by a cantilever part and which is connected to a region of the seat part that is adjacent to the rear region of a seat surface section of the seat part.

18 Claims, 6 Drawing Sheets

(56) References Cited

U.S. PATENT DOCUMENTS

| | | | | | |
|---|---|---|---|---|---|
| 6,082,824 | A * | 7/2000 | Chow | A47C 7/022 | 297/452.22 |
| 6,238,000 | B1 * | 5/2001 | Hallmark | A47C 1/03238 | 297/300.5 |
| 6,709,056 | B2 * | 3/2004 | Bock | A47C 1/03255 | 267/155 |
| 6,863,346 | B2 * | 3/2005 | Zund | A47C 1/023 | 297/300.5 |
| 7,036,882 | B2 * | 5/2006 | Elzenbeck | A47C 1/03233 | 297/300.1 |
| 7,806,478 | B1 * | 10/2010 | Cvek | A47C 1/03255 | 297/300.1 |
| 8,833,856 | B2 * | 9/2014 | Uhlenbrock | A47C 1/03255 | 297/300.2 |
| 2002/0109384 | A1 | 8/2002 | Hansen | | |
| 2004/0004380 | A1 * | 1/2004 | Horiki | A47C 1/03255 | 297/300.5 |
| 2004/0140702 | A1 * | 7/2004 | Daeschle | A47C 1/03255 | 297/300.5 |
| 2004/0174057 | A1 * | 9/2004 | Elzenbeck | A47C 1/03233 | 297/300.5 |
| 2004/0212235 | A1 * | 10/2004 | Elzenbeck | A47C 1/03233 | 297/300.5 |
| 2015/0245714 | A1 * | 9/2015 | Schneider | A47C 1/03255 | 297/300.5 |

FOREIGN PATENT DOCUMENTS

| | | | | | |
|---|---|---|---|---|---|
| EP | 0 265 782 | A2 | | 5/1988 | |
| EP | 1 230 876 | A1 | | 8/2002 | |
| JP | WO 2009147869 | A1 | * | 12/2009 | A47C 1/03255 |
| JP | WO 2010050175 | A1 | * | 5/2010 | A47C 1/03255 |

* cited by examiner

FUNCTIONAL CHAIR

RELATED APPLICATIONS

This application is a national phase of International Patent Application No. PCT/EP2013/000702, filed Mar. 8, 2013, which claims the filing benefit of German Patent Application No. 10 2012 002 288.1, filed Mar. 8, 2012, the contents of both of which are incorporated herein by reference.

FIELD OF THE INVENTION

The invention relates to a functional chair having a foot part and a seat part with a supporting mechanism which connects the seat part to the foot part.

BACKGROUND OF THE INVENTION

Functional chairs of this kind are known in varying form of embodiment. They offer possibilities for setting the position and orientation of the seat and of parts of the latter, with the aim of making it possible to sit in a variable and fatigue-free manner.

In functional chairs of this kind, a seat-surface section and a backrest section of the seat are, as a rule, capable of being displaced and set in relation to one another.

This leads to the occurrence, at the rear end of the seat-surface section and at the lower end of the backrest section, of translatory relative movements which are perceived as unpleasant.

SUMMARY OF THE INVENTION

An intention of the present invention is to further develop a functional chair of the kind initially discussed, in such a way, by means of the present invention, that it continues to make it possible to set the seat but, on the other hand, without any translatory relative movements taking place in the transitional region between the seat-surface section and the backrest section.

This object may be achieved, according to the invention, by means of a functional chair having a supporting mechanism which has: a cantilever part which is connected to the foot part by an internally located end and which extends away from the foot part with a radial component of extension, a supporting part which is attached in an articulated manner to the cantilever part at a point which is remote from the ends of the cantilever part and is connected, by a free end, to a region of a seat part which is distant from a front edge of the seat part, and a sliding mounting which is provided at the free end of the cantilever part and via which a section of the seat part which is adjacent to the front edge of the seat part is carried by the cantilever part.

In the functional chair according to the invention, a substantially constant relative position and relative inclination exists between the seat-surface section and the backrest section. This constant relationship would be provided in a precise manner if the seat-surface section and the backrest section were manufactured from rigid material. If they are manufactured from elastically deformable material, minor changes in the angle included between the seat-surface section and the backrest section can take place against spring force.

With the aid of the functional chair according to the invention it is possible to lower the rear end of the seat-surface section, with the front edge of said seat-surface section remaining substantially at the same height. The backrest section is inclined with said seat-surface section, in accordance with the angular adjustment of the latter.

As a result of the mechanism indicated, the desired setting of the seat can be carried out reliably and with simple means.

Advantageous further development of the invention form the subject of additional aspects of the invention.

What is achieved by means of the further development of the invention according to another aspect of the invention is that the seat is satisfactorily supported by the supporting part, even against tipping movements about an axis extending in the direction of the depth. Under these circumstances, a connection between the free ends of the supporting arms makes it possible to guarantee support having a strong load-bearing capacity, while using little material.

The further development of the invention according to another aspect of the invention makes it possible to fasten a backrest part to the supporting part in a simple manner.

In a functional chair according to another aspect of the invention, armrest parts can be attached in a very simple manner. Under these circumstances, the space located under the armrest part is free, so that jackets cannot get caught at that point.

In a functional chair according to an additional aspect of the invention, the sliding bearing, and thereby the front section of the seat part, is satisfactorily protected against tilting.

In a functional chair according to yet another aspect of the invention, the seat can be moved, against spring force, out of its normal position in which its seat-surface part is oriented approximately horizontally.

By means of the further development of the invention according to another aspect, a sliding bearing which is simple and capable of bearing loads is obtained for the seat part.

In a functional chair according to another aspect of the invention, the pin-and-slot connection which is already provided for guiding the front end of the seat part may also serve to lock the seat in its normal position with the seat surface extending approximately horizontally.

By means of the further development of the invention according to another aspect, a secure connection between the sliding bearing and the seat is obtained.

Under these circumstances, a settable restoring force for the seat part is obtained in a very simple manner according to another aspect of the invention.

The further development of the invention according to another aspect of the invention is advantageous with respect to identical support for the two lateral regions of the front section of the seat part. If, under these circumstances, the free ends of the cantilever arms are connected by a cross-piece, there is once again obtained, while using little material, a framework which is suitable for absorbing major forces.

In a functional chair according to another aspect of the invention, the cross-piece connecting the cantilever arms may serve, at the same time, as a spring seat and a base part for fitting-on further elements of the chair.

What is achieved by means of the further development of the invention according to another aspect of the invention is that the seat-surface part is able to deform elastically somewhat when the seat is subjected to load and lowered. By this means, the rear section of the seat-surface part can be inclined to a greater extent, while the front section of said seat-surface section is tilted only a little. This is advantageous with respect to avoiding pressure loadings on that region of the user's thigh which is adjacent to the knee.

The further development of the invention according to yet another aspect of the invention also serves for the user's comfort, since the seat surface is softer in the region of a user's ischial tuberosities.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

The invention will be explained in greater detail below with the aid of an exemplary embodiment and with reference to the drawings, in which.

DETAILED DESCRIPTION OF THE PRESENT INVENTION

Figure 1:
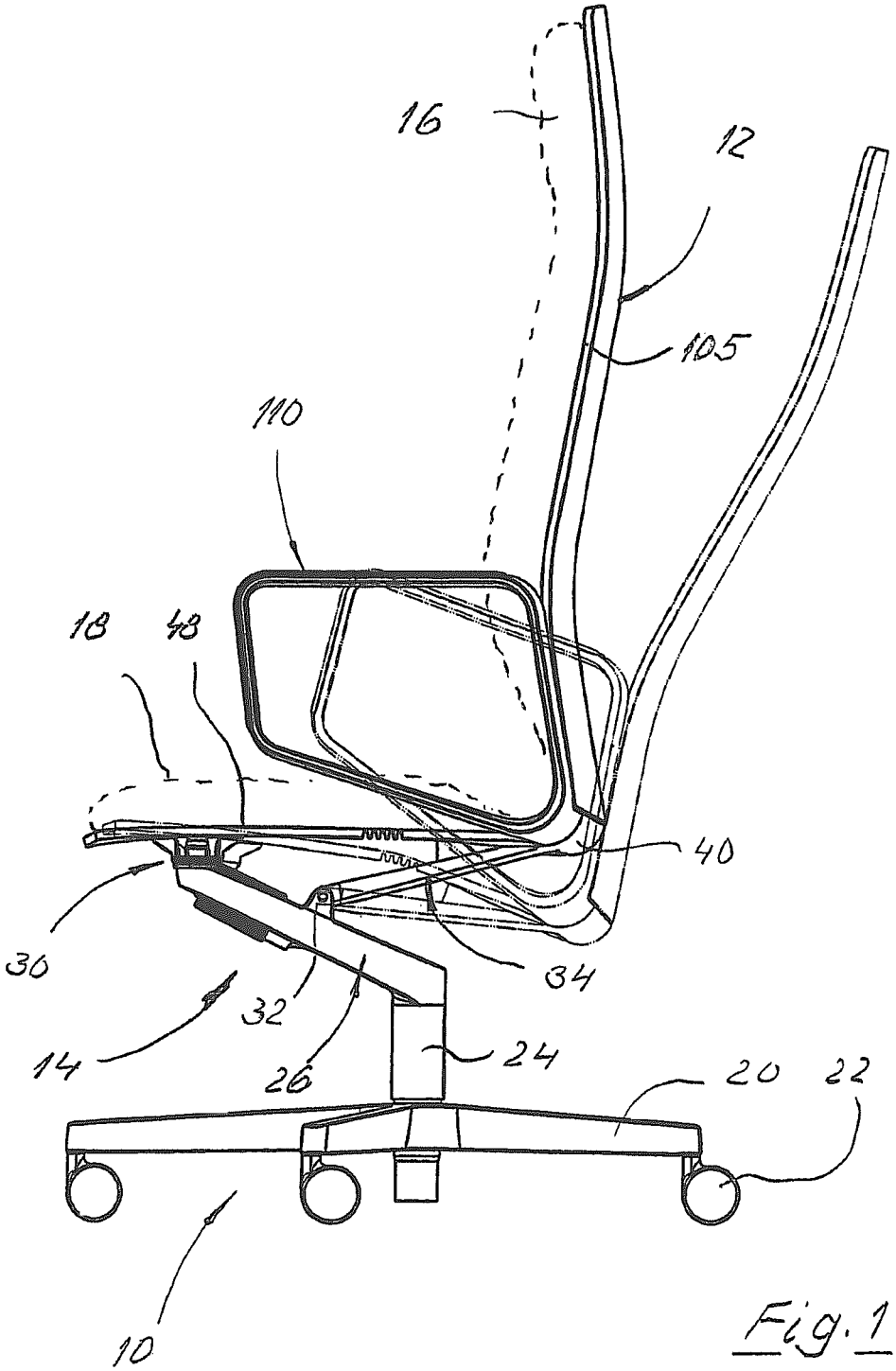
FIG. 1 shows a lateral view of a functional chair in a non-loaded normal position (in solid lines) and a lowered rest position (in broken lines)

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

In the present description and the claims, use is made of various indications of direction; these relate to an observer standing in front of the functional chair. The direction of the width therefore extends perpendicularly to the plane of the drawing in FIG. 1. The direction of the depth extends from left to right in FIG. 1, and the direction of the height extends from bottom to top in FIG. 1.

FIG. 1 shows a functional chair which has, as its main components, a foot part 10, a seat part 12 and also a supporting mechanism 14, via which said seat part 12 is connected to said foot part 10.

Typically, there are also attached to the seat part 12 a back cushion 16 and a seat cushion 18, which cushions are indicated only diagrammatically in outline.

The foot part 10 has a foot-spider 20 with castors 22. The centre of the foot-spider 20 carries a vertical tube 24.

The supporting mechanism 14 comprises a cantilever arm 26 whose lower end, which is located on the inside radially, is seated in a rotatable manner on the upper end of the vertical tube 24. Said cantilever arm 26 extends obliquely leftwards and upwards in FIG. 1. Via a sliding mounting, which is designated as a whole by 30, the free end of the cantilever arm 26 carries a front section of the seat part 12.

Approximately in the middle of the cantilever arm 26, a supporting part 34 is attached in an articulated manner via a pivot bearing 32. As can be seen particularly from FIGS. 4 and 5, the supporting part 24 comprises two supporting arms 36, 38 which extend away from the axis of the foot part and the free ends of which are connected by a connection-carrier 40 to form an isosceles triangle. As can be seen from FIG. 5, said connection-carrier 40 has a slightly arcuate geometry.

Similarly, the cantilever part 26 has two cantilever arms 42, 44 which extend away from the axis of the foot part 10 in a diverging manner and are connected at their free ends by a cross-piece 46. There is thus obtained, once again, a triangular framework which has a good load-bearing capacity, even while using little material.

For its part, the seat part 12 has a seat-surface section 48 which extends approximately horizontally when in the normal position and in which a bending section 50 is provided at approximately two thirds of its extension in terms of depth. This section is provided in the shape of a number of adjacent transverse triangular grooves 52.

Figure 2:
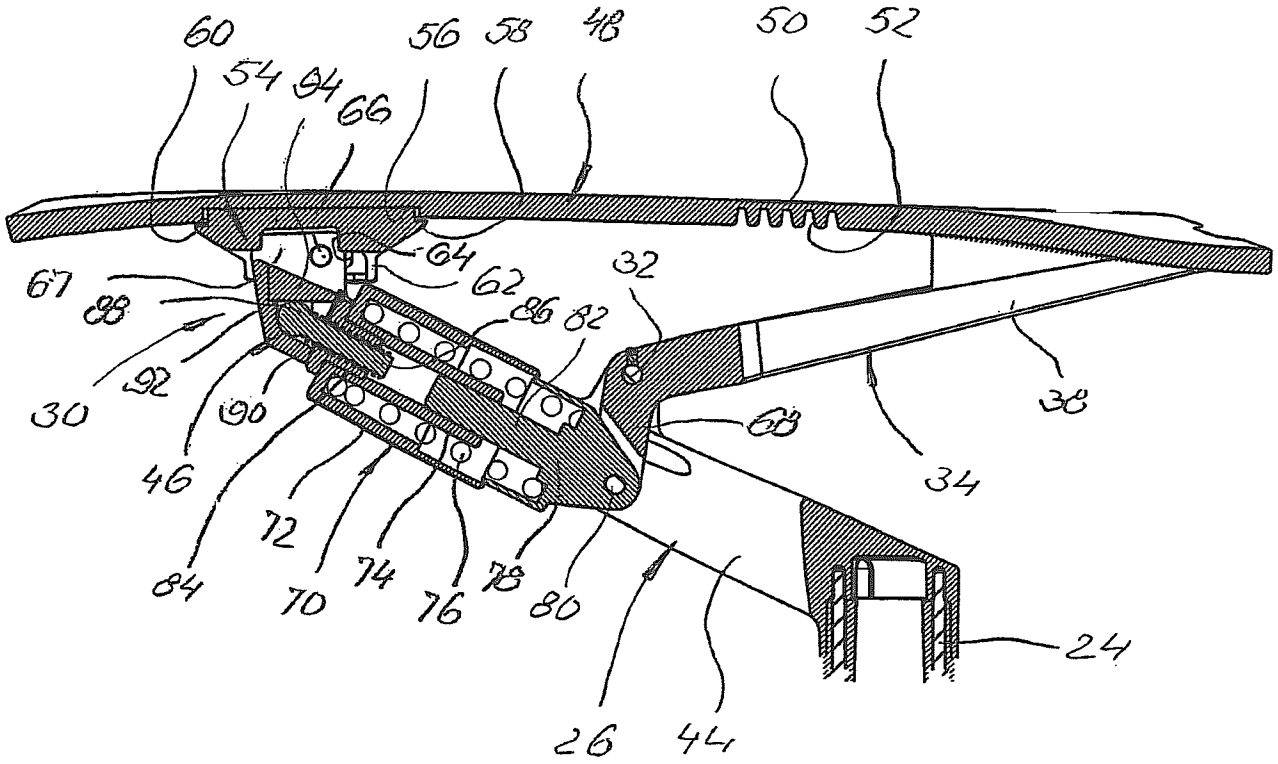
FIG. 2 shows a vertical section through a seat-surface part of the functional chair according to FIG. 1, together with a supporting mechanism via which the seat part is mounted on a foot part of said functional chair.
Figure 4:
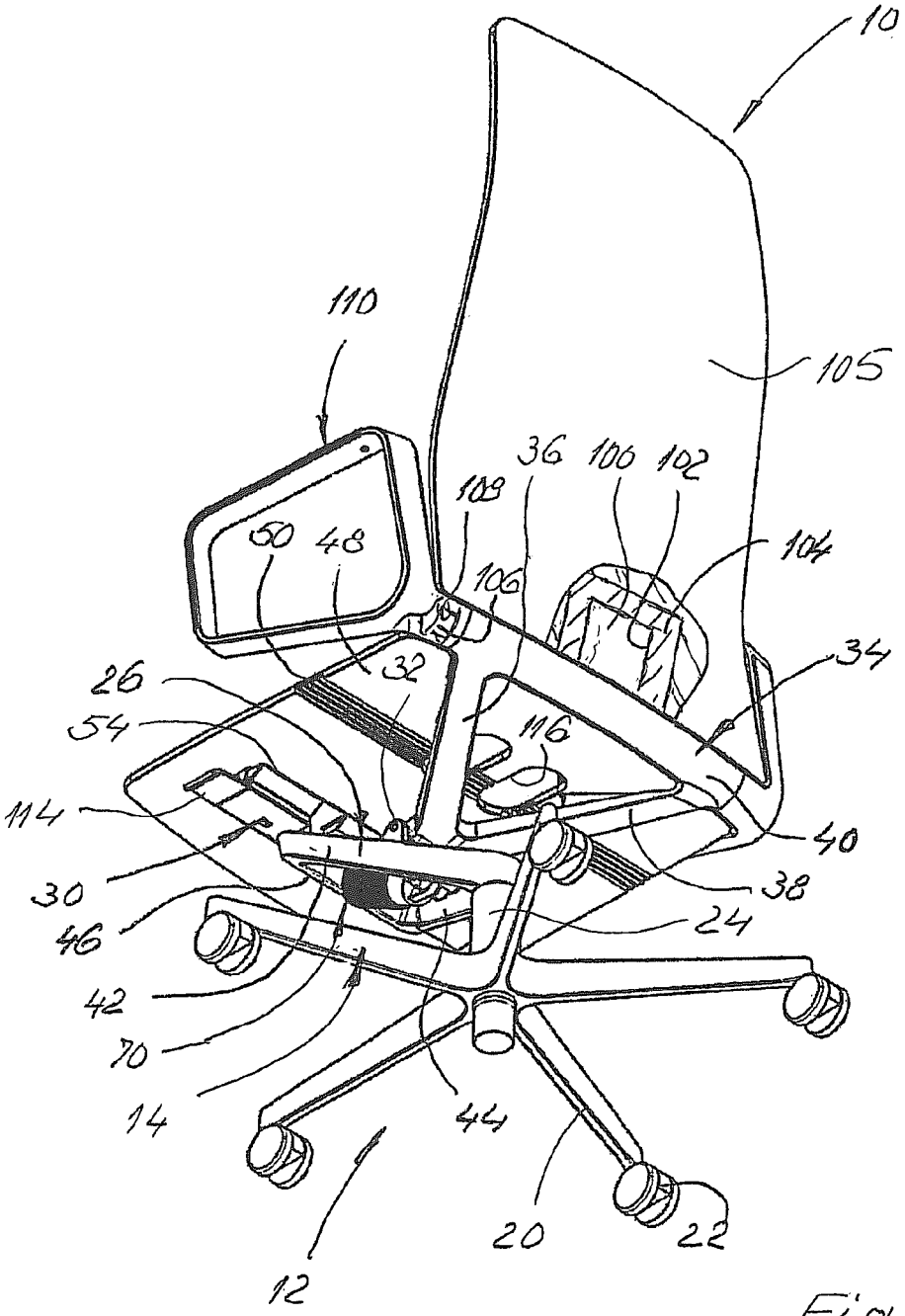
FIG. 4 shows a perspective plan view of the underside of the seat part, viewed obliquely from behind.
Figure 5:
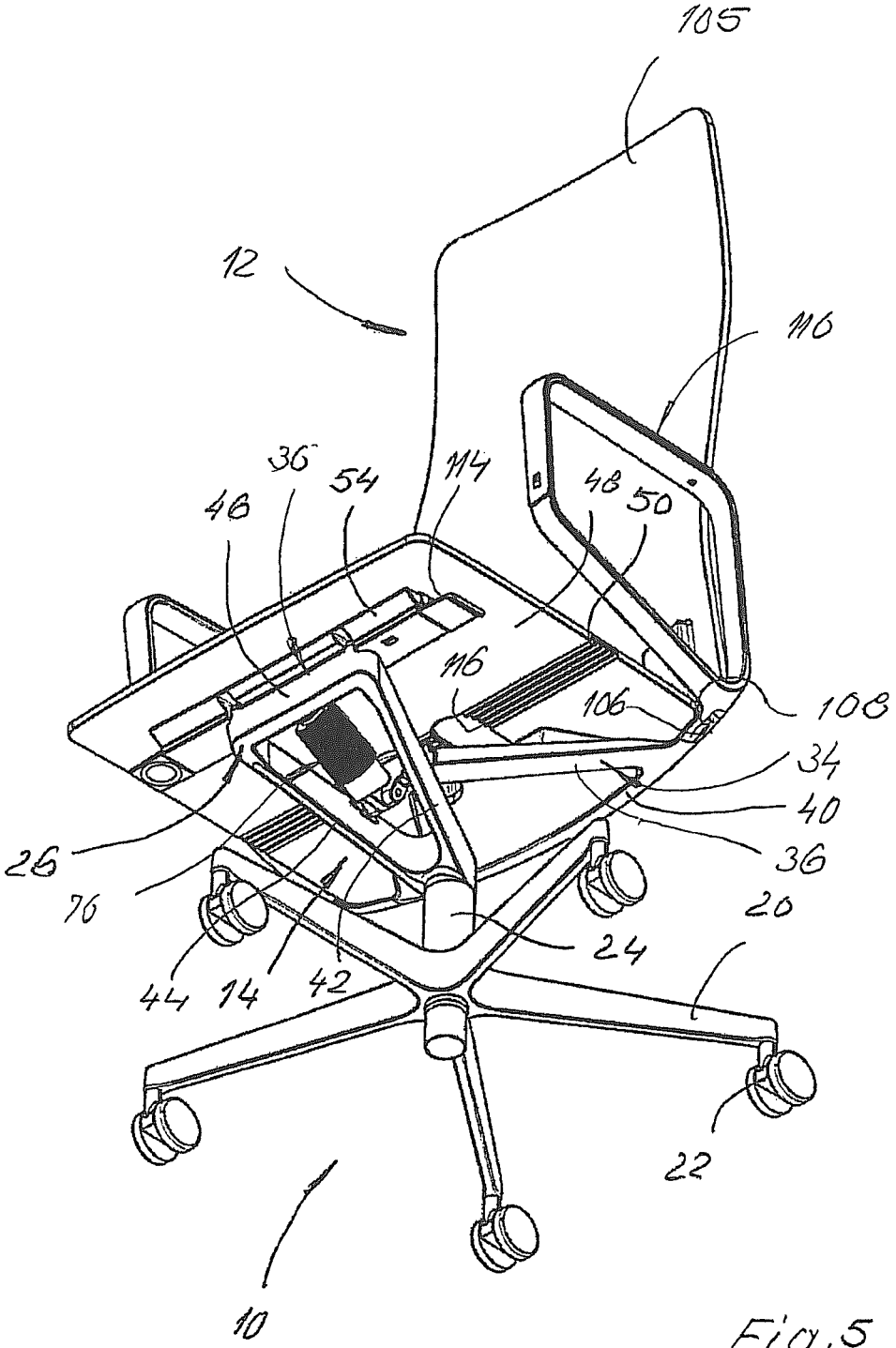
FIG. 5 shows a perspective plan view of the underside of the seat part, viewed obliquely from the front.

As can be seen particularly from FIGS. 2, 4 and 5, a bearing strip 54 extends in the direction of the width (the transverse direction) at a point on the seat-surface section 48 which amounts to about 20 to 25% of its dimension in depth. Said bearing strip 54 has a foot section which has a rectangular cross-section and is seated in a complementary depression 56 constructed in the underside of the seat-surface section 48. Lateral ribs 58, 60 belonging to the bearing strip 54, which have a triangular cross-section, overlap the edges of the depression 56.

Slots 64 are constructed in end sections 62 of the bearing strip 54 which hang down at the sides. Engaging in said slots is a guide pin 64 which is carried by a bearing tab 66 belonging to the cantilever part 26, which bearing tab is raised at the sides.

The bearing tab 66 is, at the same time, located with slight clearance opposite the end section 62 of the lattice strip 54 in which the slot 64 is constructed.

As can be seen particularly from FIG. 2, the supporting part 34 has a formed-on driving lever 68 which works on a spring cartridge which is designated, as a whole, by 70.

Said spring cartridge comprises a cup-shaped housing 72 which has a central tubular section 74. A helical compression spring 76 is arranged in the annular space which lies between the tubular section 74 and the peripheral wall of the housing 72. Said spring acts upon a spring seat 78 which is connected to the end of the driving lever 68 in an articulated manner via a pin 80.

The spring seat 78 has a guide bar 82 which extends within the interior of the tubular section 74.

The base of the housing 72, which base is located on the left in FIG. 2, is provided with a threaded bush 84 within which a setting screw 86 can be adjusted.

At its end that lies outside the spring cartridge 70, the setting screw 86 has a strip-shaped head section with a circular cross-section which serves as a rolling bearing. The appertaining bearing seat is formed by two legs 90, 92 of the cross-piece 46 as well as a prismatic masking part 94 with a triangular cross-section, which part is carried by the upper end of the leg 92.

Figure 3:
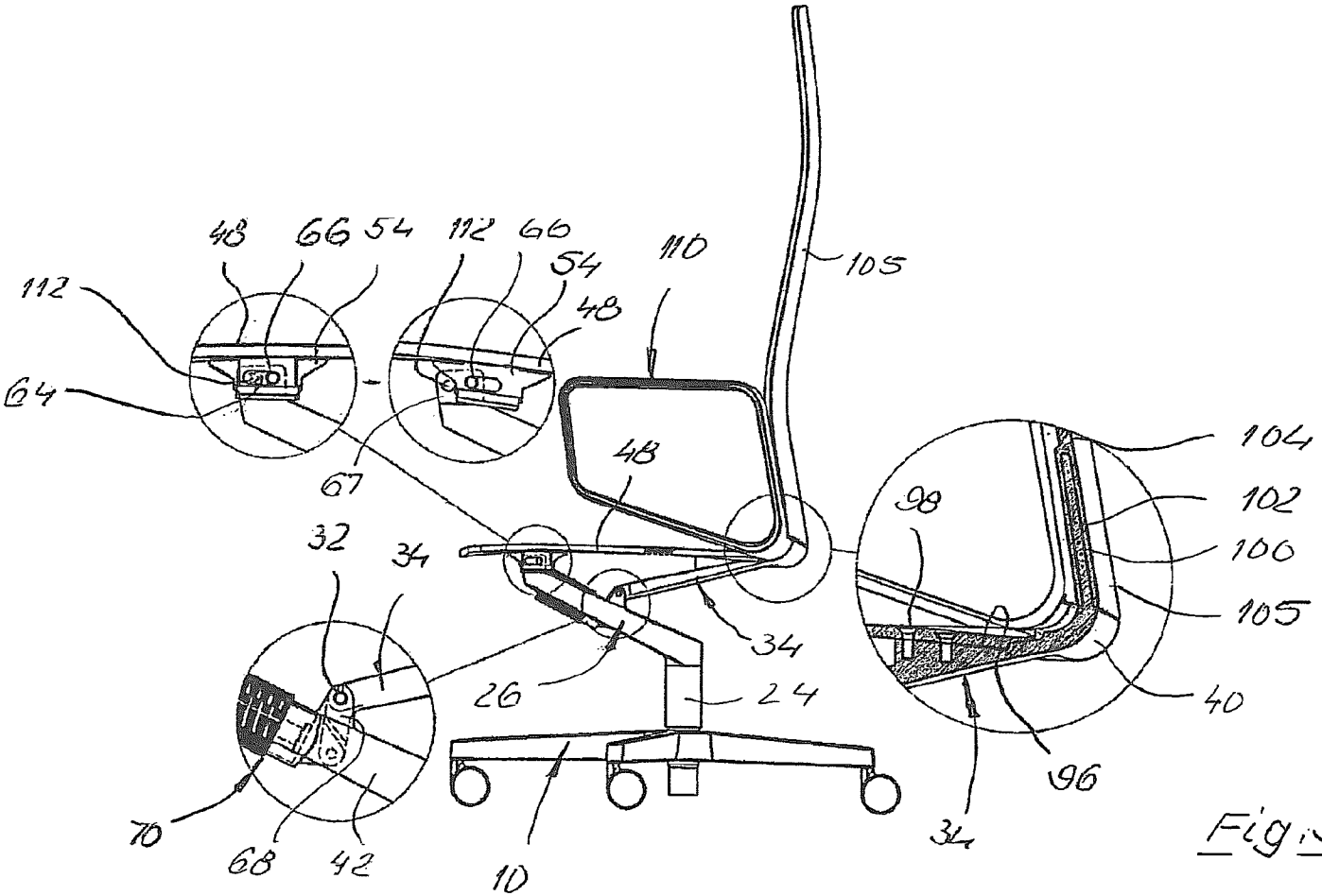
FIG. 3 shows a similar view to that in FIG. 1, showing details of a sliding mounting for the front end of the seat part and details of a fastening of the rear end of said seat part to the supporting mechanism.

As can be seen from FIG. 3, that end of the supporting part 34 which is located on the right in the drawing is provided with a stepped contact surface 96 for the rear end of the seat-surface section 50 which is fixed at that point by means of screws 98.

That end of the connection-carrier 40 which is located on the right in FIG. 3 is provided, at its centre, with a projecting tongue 100 which is capable of cooperating with a complementary clearance 102 which is constructed in an insert 104 embedded in the lower end of a backrest section 105.

The supporting part 34 has laterally protruding projections 106 which are formed on at the two sides of the rear connection-carrier 40 and which combine with clearances 108 provided in armrest parts 110 to form a push-in connection. In this way, the armrest parts 110 can be easily taken off and put on.

A locking pin 112, which can be moved in and out of the track of a slot 64 by a slide 114 (FIG. 4), is provided for locking the seat part 14 in the normal position. Said locking pin 112 is indicated in outline in broken lines in FIG. 3.

For the purpose of setting the spring pretensioning for the seat part 12, the outside of the housing 72 of the spring cartridge 70 is provided with knurling or a friction coating. It is thus possible to set the pretensioning of the helical compression spring 76 by rotating the housing 72 (with the setting screw 86 fixed in the direction of rotation).

The functional chair described above can be packed in a compact manner, since the backrest section 105 and the seat-surface section 48 can be easily mounted on, and demounted from, the supporting part 34.

The supporting mechanism described permits sitting both in an upright manner and in a backwardly inclined manner. In the course of transition between the two sitting positions, no appreciable relative movement occurs between the seat-surface section 48 and the backrest section 105.

The mechanism described is of simple and robust design.

The parts of the supporting mechanism 14 may be predominantly injection-moulded parts made of aluminium or an aluminium alloy. The seat part 12 and its seat-surface section 48, as well as its backrest section 105, may be moulded parts which are substantially rigid and exhibit only a slightly resilient behaviour which can be predetermined via the choice of material and the geometry, as is known to the person skilled in the art in the field of moulding plastic parts. As materials, use may preferably be made, for the backrest section, of a polyamide with short glass-fibre reinforcement (preferably PA6 GF 15) and, for the seat-surface section, of a polypropylene.

Figure 6:
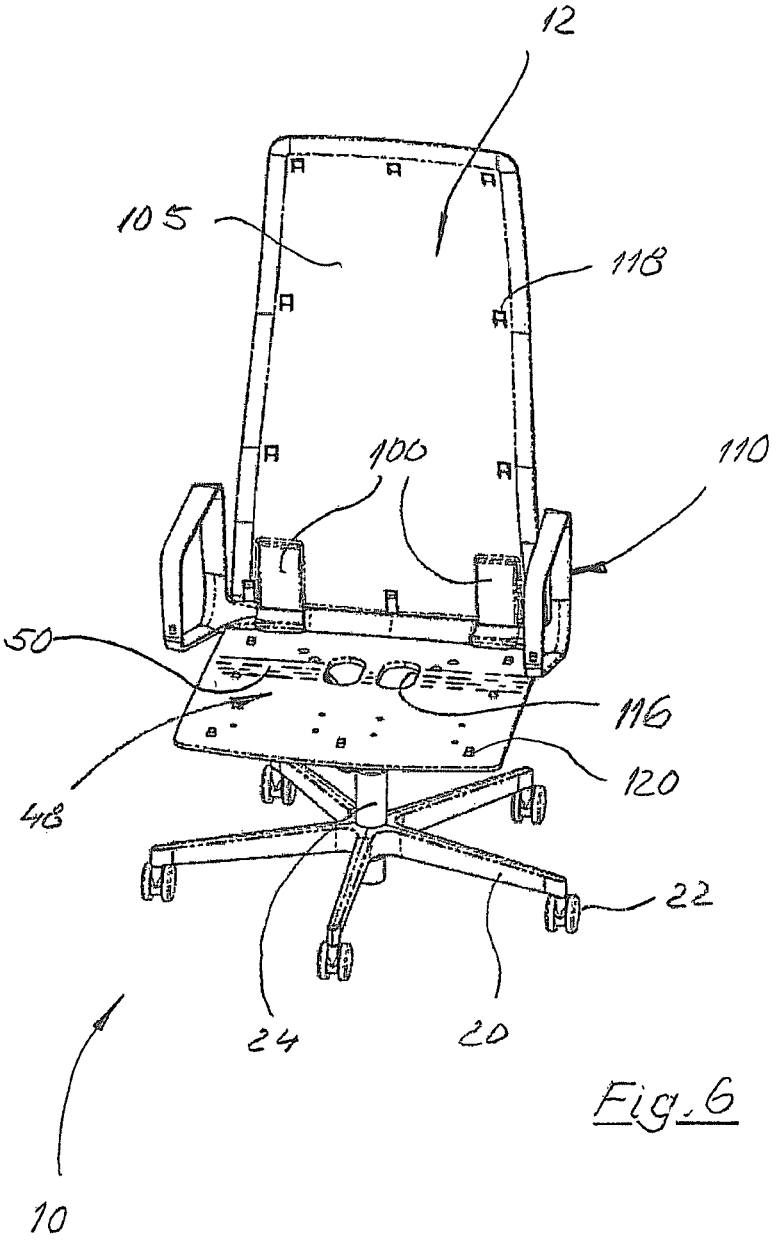
FIG. 6 shows a perspective plan view of the front side of a modified functional chair without cushions.

In the case of the slightly modified exemplary embodiment according to FIG. 6, only the differences in relation to the exemplary embodiment described above will be explicitly described. The remaining components are to be regarded as similar. The reference numerals in FIGS. 1 to 5 are also used.

The backrest section 105 of the seat part 12 is firmly slipped, by means of lower clearances 102, onto two lateral radial tongues 100 belonging to the connection-carrier 40, said clearances being moulded-in at the same time as the backrest section 105 is injection-moulded.

Shown on the front side of said backrest section 105 are fastening eyes 118 onto which a back cushion 16 can be pushed, buttoned or latched. The seat-surface part 48 carries similar fastening eyes 120 for a seat cushion 18.

The bending section 50, which is located on the underside of the seat-surface section 48, is indicated in outline in broken lines.

That part of the seat-surface section 48 which lies behind the bending section 50 is, once again, connected rigidly to the connection-carrier 40 and thus pivots, together with the seat-rest part 105, while that part of the seat-surface part 48 which lies in front of the bending section 50 may have a different inclination from, and as a rule is less steep than, the part that lies behind said bending section.

In the case of a given material for the seat-surface section 48, it is possible to set the resilient properties of the bending section 50 via the width of the strip-shaped bending section 50 (dimension in the direction from "front" to "back") and via the depth and cross-sectional shape of the grooves 52.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A functional chair comprising:

a foot part;

a seat part having a seat-surface section and a backrest section, wherein the seat-surface section of the seat part is provided with a transverse bending section, and the seat-surface section is fixed relative to the entire backrest section, the seat-surface section extending continuously from a front edge of the seat part to the backrest section along at least a portion of a width of the seat surface;

a supporting mechanism via which said seat part is connected to said foot part, wherein the supporting mechanism has a cantilever part which is connected to the foot part by an internally located end and which extends away from said foot part with a radial component of extension, a supporting part which is attached in an articulated manner to the cantilever part at a point which is remote from ends of said cantilever part and is connected, by a free end, to a region of the seat part which is distant from a front edge of said seat part, proximate a rear section of the seat-surface section of the seat part, and a sliding mounting which is provided at the free end of the cantilever part and via which a front section of the seat-surface section of the seat part which is adjacent to the front edge of said seat part is carried by said cantilever part.

2. The functional chair according to claim 1, wherein the supporting part has two diverging supporting arms which are connected at a first end by a connection-carrier.

3. The functional chair according to claim 2, wherein the connection-carrier is provided with connecting means for attaching a backrest part.

4. The functional chair according to claim 2, wherein the first ends of the supporting arms or of the connection-carrier are provided with connecting means for attaching armrest parts.

5. The functional chair according to claim 1, wherein the cantilever part has two diverging arms which are connected at their ends by a cross-piece.

6. The functional chair according to claim 1, wherein the supporting part is connected to a driving arm which cooperates with an entry part of a spring which is supported on the cantilever part.

7. The functional chair according to claim 6, wherein the sliding mounting has a bearing strip which is partly seated in a depression constructed in the underside of the seat part.

8. The functional chair according to claim 6, wherein the spring has a supporting part which can be set in a direction of the spring and which is supported on the cantilever part in a pivotable manner.

9. The functional chair according to claim 1, wherein the sliding mounting has at least one spaced-apart pin-and-slot connections.

10. The functional chair according to claim 9, further comprising a locking pin which can be moved between a blocking position which cooperates with the slot, and a releasing position which clears the latter.

11. The functional chair according to claim 1, wherein the cantilever part has two cantilever arms which increasingly diverge as a distance from an axis of the foot part grows, and that the free end of said cantilever arms are preferably connected by a cross-piece.

12. The functional chair according to claim 11, wherein the cross-piece is formed by an angle profile which is masked in the upward direction by a cover part.

13. The functional chair according to claim 1, wherein the seat-surface section of the seat part has, in a region of the ischial tuberosities, two apertures which are spaced apart in the direction of the width.

14. The functional chair according to claim 1, wherein the transverse bending section comprises a plurality of adjacent triangular grooves.

15. The functional chair according to claim 1, wherein the sliding mounting has at least two spaced-apart pin-and-slot connections.

16. The functional chair according to claim 1, wherein the transverse bending section includes a flat seat portion and a plurality of adjacent triangular groves provided underneath the flat seat portion.

17. A functional chair comprising:

a foot part;

a seat part having a seat-surface portion and a backrest portion, wherein the seat-surface portion includes a front edge, a top seat surface extending continuously from a front edge of the seat-surface portion to the backrest portion along at least a portion of a width of the seat-surface portion, a bottom portion underneath the top seat surface, and a plurality of adjacent triangular grooves on the bottom portion of the seat-surface portion so that a rear portion of the seat-surface portion may be may be lowered while the front edge of the seat-surface portion remains at a substantially constant height;

a supporting mechanism via which said seat part is connected to said foot part, wherein the supporting mechanism has a cantilever part which is connected to the foot part by an internally located end and which extends away from said foot part with a radial component of extension, a supporting part which is attached in an articulated manner to the cantilever part at a point which is remote from ends of said cantilever part and is connected, by a free end to the rear portion of the seat-surface portion, and a sliding mounting which is provided at the free end of the cantilever part and via which a front section of the seat-surface portion of the seat part which is adjacent to the front edge of said seat part is carried by said cantilever part.

18. The functional chair of claim 17 wherein the entire backrest portion has a substantially constant relative inclination with the rear portion of the seat-surface portion.

* * * * *